US005905328A

United States Patent [19]

Wilkinson

[11] Patent Number: 5,905,328

[45] Date of Patent: May 18, 1999

[54] FIELD EMISSION DISPLAY DEVICE HAVING FILM CONTAINING MICROLENSES

[75] Inventor: Dean A. Wilkinson, Boise, Id.

[73] Assignee: Micron Technology, Inc., Boise, Id.

[21] Appl. No.: 08/766,410

[22] Filed: Nov. 22, 1996

[51] Int. Cl.[6] ..... H01J 29/10

[52] U.S. Cl. ..... 313/309; 313/495; 313/461; 313/112

[58] Field of Search ..... 313/309–336, 313/351, 495, 461, 465, 466, 473, 474–112; 359/652, 653, 654, 621, 619

[56] References Cited

U.S. PATENT DOCUMENTS 4,804,253 2/1989 Stewart ..... 313/478

5,126,620 6/1992 Haraga et al. ..... 313/111

*Primary Examiner*—Vip Patel

*Attorney, Agent, or Firm*—Seed and Berry LLP

[57] ABSTRACT

A field-emission display includes a faceplate having an inner or outer surface covered by a depixellation film containing a large number of graded refractive index microlenses. The depixellation film averages or spreads the light illuminated by each pixel so that the illumination intensity is relatively constant across the surface of the pixel. As a result, the viewing characteristics of the field-emission display are improved.

50 Claims, 3 Drawing Sheets

FIELD EMISSION DISPLAY DEVICE HAVING FILM CONTAINING MICROLENSES

This invention was made with Government support under Contract No. DABT63-93-C-0025 awarded by Advanced Research Projects Agency (ARPA). The government has certain rights in this invention.

TECHNICAL FIELD

This invention relates to field-emission displays, and more particularly to a field-emission display faceplate in which the pixels of the display are uniformly illuminated.

BACKGROUND OF THE INVENTION

Matrix displays are commonly used for a wide variety of applications including portable computer displays, displays for various instruments, and camcorder viewfinders, to name a few. The most commonly used matrix display is currently the liquid crystal display ("LCD"). In liquid crystal displays and other matrix displays, individual pixels are individually illuminated at locations where an energized row overlaps an energized column. A desired image is created by sequentially controlling the illumination of each pixel in a row, and then similarly scanning each row in sequence.

The pixels of liquid crystal displays are illuminated substantially uniformly across the surface of the pixel. The pixels are generally separated from each other by a dark border or mask in order to improve the contrast of the display. However, abrupt changes in illumination of adjacent pixels, such as at the borders of letters, can produce an uneven appearance, i.e., a jagged edge or border. Also, gray scale images displayed on liquid crystal displays can have a grainy appearance. Attempts have been made to solve these problems by placing a depixellation film on the outer surface of liquid crystal displays to "blend" light emanating from adjacent pixels, thereby eliminating jagged edges and graininess. Such depixellation film is basically composed of a large number of microlenses, generally of the graded refractive index type, mounted on a transparent substrate or film. Such depixellation films are available from a variety of manufacturers, including Microsharp US, of Nashua, N.H. These conventional depixellation films have significantly improved the viewing characteristics of liquid crystal displays.

Another variety of matrix display is the field-emission display in which electrons are emitted from cold-cathode emitters mounted on a baseplate faceplate, similar in composition to the faceplates of cathode-ray tubes, attracts the emitted electrons to create an image variable through the faceplate. The sizes of the pixels used in field-emission displays can be made very small. For this reason, as well as for other reasons, the jagged edges and graininess often occurring in liquid crystal displays is not as significant a problem in field-emission displays. Thus, the depixellation film is not as apparent for field-emission displays. However, unlike the uniform illumination of liquid crystal displays, the pixels of field-emission displays are generally non-uniformly illuminated. The difference in the pixel illumination characteristics between liquid crystal displays and field-emission displays are best explained with reference to FIGS. 1–3. FIG. 1 illustrates a conventional matrix display 10 which may be either a liquid crystal display or a field-emission display. FIG. 2 is a graph 20 of the illumination characteristics of a liquid crystal display taken along the line 2—2 of FIG. 1. (Only seven of the hundreds or thousands of pixels along the line 2—2 are shown.) As illustrated in FIG. 2, pixels 22–28 and 34 are illuminated to substantially the same, relatively high intensity, while pixels 30 and 32 are substantially dark. A border 38 between each of the pixels 22–34 and an adjacent pixel is masked and thus non-illuminated, or dark. It will be apparent from FIG. 2 that the illumination intensity of each pixel 22–34 is substantially uniform across the surface of the pixel. Thus, the sole function of the depixellation film used in prior art liquid crystal displays is to "smooth" the abrupt change in intensity between adjacent pixels illuminated at substantially different intensities, such as the pixels 28, 30 of FIG. 2.

The illumination intensity along the line 2—2 for a field-emission display is illustrated in FIG. 3. (Once again, only seven of the hundreds or thousands of pixels along line 2—2 are illustrated.) As illustrated in FIG. 3, seven pixels 42–54 are illuminated at varying intensity. However, unlike the pixel illumination of liquid crystal displays illustrated in FIG. 2, the field-emission display pixels are not uniformly illuminated across the surface of the pixel. Instead, the intensity peaks toward the center of each pixel 42–54. Furthermore, the location of the peak intensity, as well as the manner in which the intensity decreases toward the edges, can vary from one pixel to the next. Significantly, however, the abrupt changes in illumination intensity from one pixel to the next is not present in the illumination characteristics of field-emission displays, as illustrated in FIG. 3. Thus, there is no apparent need for using the depixellation films commonly used with liquid crystal displays. However, the non-uniformity of illumination within the pixels degrades the appearance of field emission displays in manners that do not occur in liquid crystal displays since the illumination within the pixels is uniform. There has heretofore been no solution to the degradation in viewing characteristics of field-emission displays resulting from this non-uniformity of pixel illumination.

SUMMARY OF THE INVENTION

According to one aspect of the invention a field-emission display includes a baseplate and a faceplate positioned parallel to and spaced apart from the baseplate. The faceplate includes a transparent substrate having an inner surface facing the baseplate. The inner surface of the substrate is coated with a substantially transparent layer of conductive material which is, in turn, coated with a layer of cathodoluminescent material. Significantly a depixellation film, a film containing a plurality of microlenses, or a plurality of microlenses are positioned so that light emitted by the cathodoluminescent material passes through the depixellation film or microlenses. The film or microlenses preferably overlies the inner or outer surface of the substrate, such as by being placed on the inner or outer surface of the substrate, respectively. The film or microlenses improve the viewing characteristics of the field-emission display by averaging the intensity of, or spreading out, light emitted by each pixel. As a result, the light emitted by each pixel is relatively uniform.

DETAILED DESCRIPTION OF THE INVENTION

Figure 1:
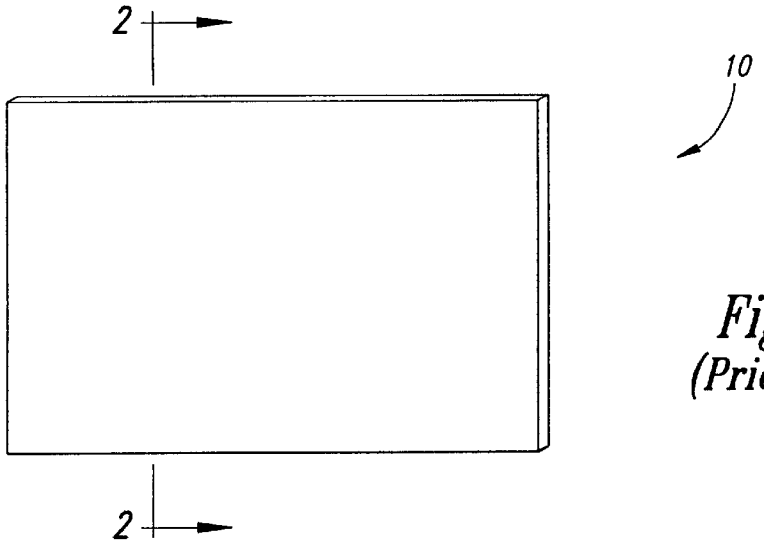
Fig. 1 (Prior Art)
FIG. 1 is an isometric view of a conventional matrix display such as a liquid crystal display or field-emission display.
Figure 2:
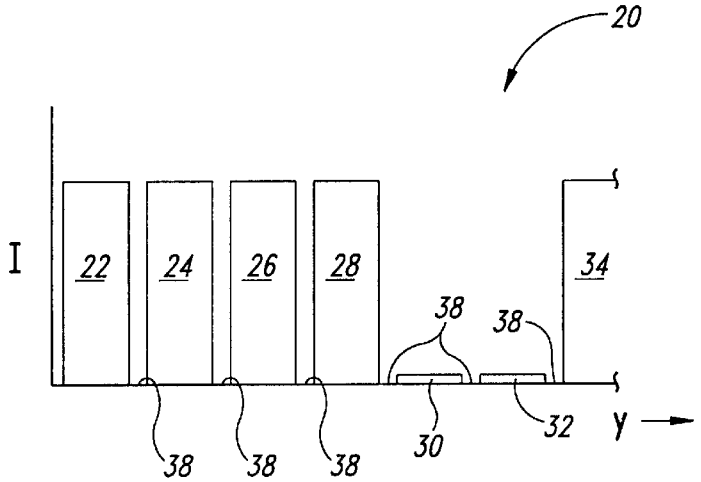
Fig. 2 (Prior Art)
FIG. 2 is a graph of the pixel illumination intensity of a liquid crystal display taken along the line 2—2 of FIG. 1.
Figure 3:
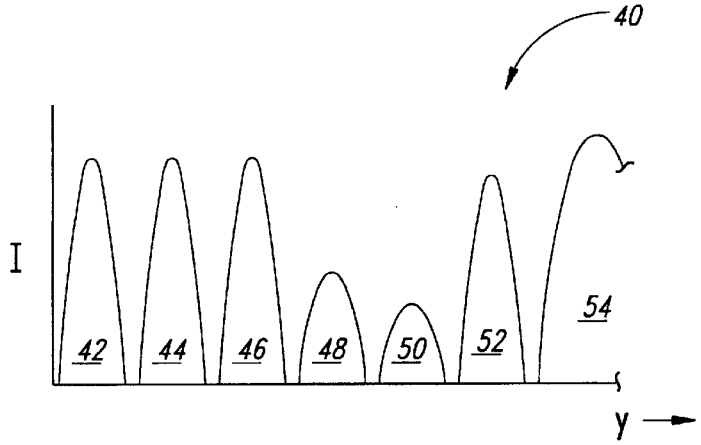
Fig. 3 (Prior Art)
FIG. 3 is a graph of the pixel illumination intensity of a conventional field-emission display taken along the line 2—2 of FIG. 1.
Figure 4:
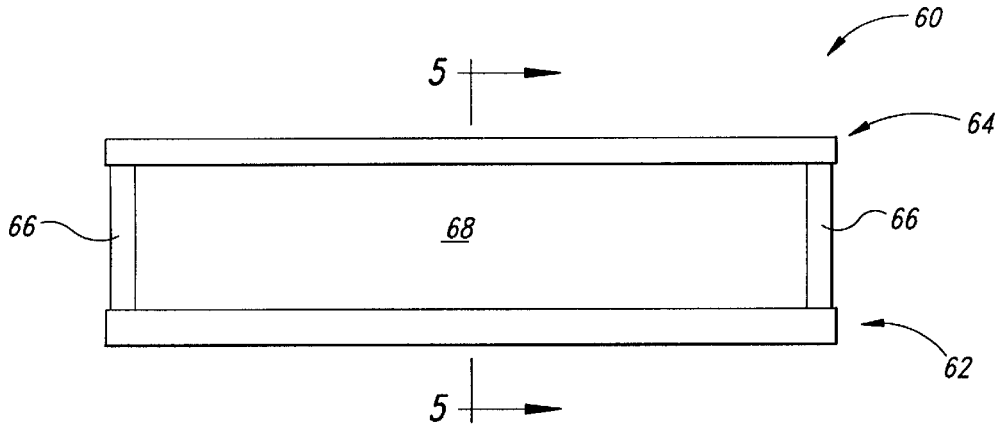
FIG. 4 is cross-sectional view of a field-emission display using a preferred embodiment of the inventive field-emission display.

A field-emission display 60 in accordance with a preferred embodiment of the invention is illustrated in FIG. 4. The field-emission display 60 includes a baseplate 62 and a faceplate 64 separated from each other by seals 66 extending along the periphery of the display 60. The seals 66 not only position the baseplate 62 and the faceplate 64 parallel to each other, but they also isolate the area 68 between the baseplate 62 and the faceplate 64 from the external environment. As a result, the area 68 may be evacuated as is conventional in field-emission displays.

Figure 5:
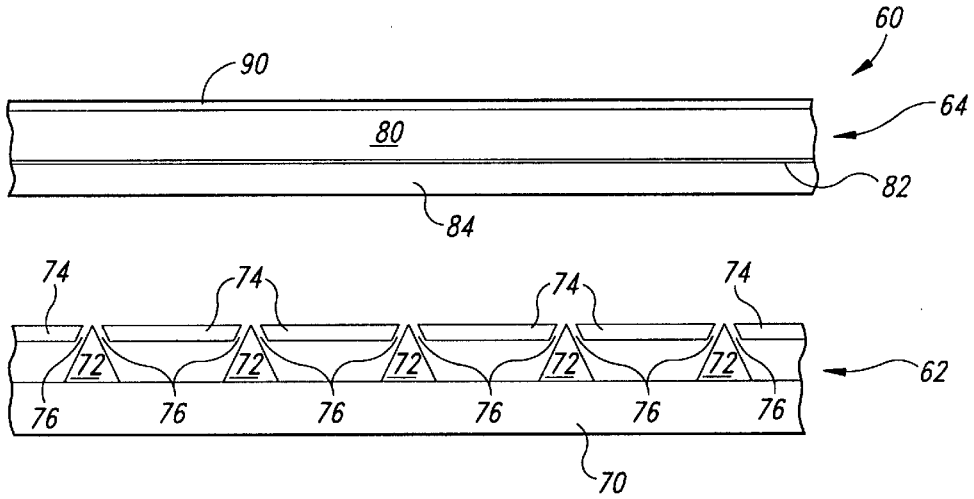
FIG. 5 is a cross-sectional view taken along the line 5—5 of FIG. 4.

With further reference to FIG. 5, the baseplate 62 may include a substrate 70 of silicon or some other material. A plurality of conical emitters 72 are supported on the substrate 70 and an extraction grid 74 is positioned above the substrate 70. Each emitter 72 extends into a respective aperture 76 formed in the extraction grid 74. FIG. 5 illustrates only the basic components of one type of field-emission display 62 since the structure of the baseplate 62 is not primarily involved in the inventive method and apparatus for improving the viewing characteristics of field-emission displays. Thus, a wide variety of existing baseplates 62 and baseplates that will be developed in the future may be used.

The faceplate 64 includes a transparent substrate 80 coated with a transparent layer of conductive material, such as indium oxide, forming an anode 82. The anode 82 is, in turn, coated with a layer of cathodoluminescent material 84. Although a homogeneous layer of cathodoluminescent material 84 is illustrated in FIG. 5, it will be understood that the layer of cathodoluminescent material of 84 may be composed of isolated areas of different types of cathodoluminescent material. For example, different cathodoluminescent materials may be use in different areas to provide a color field-emission display.

In practice, the emitters 72 (which may be in sets of interconnected emitters) are arranged in columns while individual extraction grids 74 are arranged in rows. An individual emitter 72 can then be selected for electron emission by driving a column of emitters 72 to a relatively low voltage and driving an extraction grid 24 row to a relatively high voltage. Electrons are then emitted from the emitter 72 in the energized column of emitters 72 that intersects the energized extraction grid 74 row.

A relatively high positive voltage on the order of 1000 volts is applied to the anode layer 82. The strong positive voltage attracts the electrons emitted by the emitter 72 so that they pass through the cathodoluminescent layer 84 before striking the anode 82. The cathodoluminescent layer 84 then emits light which is visible through the transparent substrate 80.

The preferred embodiment of the inventive field-emission display 60 illustrated in FIG. 5 differs from prior art field-emission displays in the use of a depixellation film 90 on the outer surface of the faceplate 80. The depixellation film 90 may be of the commercially available type having a large number of microlenses, preferably of the graded refractive index variety. Such depixellation film is available from Microsharp US, of Nashua, N.H. Although the depixellation film 90 is shown as being attached to the outer surface of the substrate 80, it will be understood that it may be positioned so that it overlies the outer surface of the substrate 80 by other means. For example, the depixellation film 90 may be supported above the substrate 80 by appropriate spacers (not shown). Any placement of the depixellation film 90 is acceptable as long as the light emitted from the cathodoluminescent layer 84 passes through the depixellation film 90 before being viewed.

Figure 6:
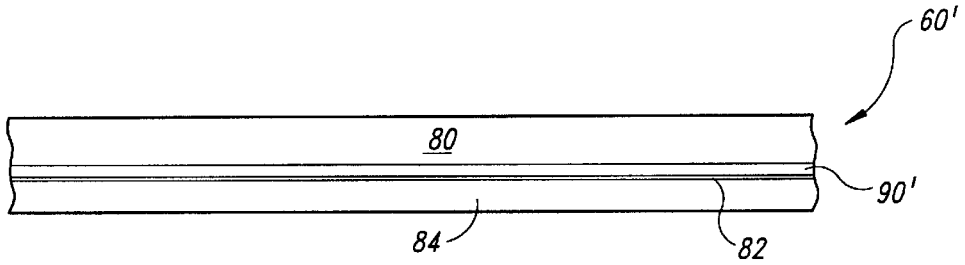
FIG. 6 is a cross-sectional view of an alternative embodiment of a field-emission display.

An alternative embodiment of the inventive field-emission display faceplate, as illustrated in FIG. 6, includes a transparent substrate 80 having an inner surface to which the depixellation film 90 is applied. The exposed surface of the depixellation film 90' is then coated with a transparent layer of conductive material to form an anode 82 which is, in turn, coated with a layer of cathodoluminescent material 84. Light emitted by the cathodoluminescent material 84 passes through the anode 82 and the depixellation film 90 before being viewed through the transparent substrate 80.

Figure 7:
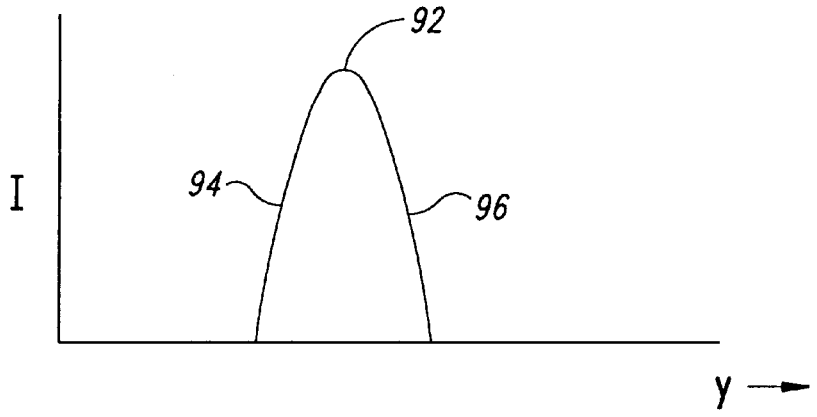
Fig. 7 (Prior Art)
FIG. 7 is graph of the illumination intensity of a single pixel in a prior art field-emission display.
Figure 8:
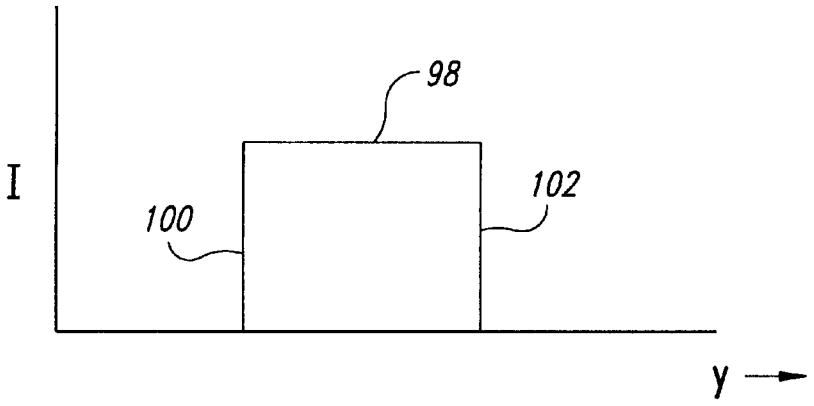
FIG. 8 is a graph of the intensity of a pixel in a preferred embodiment of the field-emission display illustrating how the illumination intensity is made substantially uniform in accordance with the preferred embodiment of the invention.

The manner in which the depixellation film 90 alters the pixel illumination characteristics of the field-emission display 60 is illustrated in FIGS. 7 and 8. FIG. 7 shows the pixel illumination intensity I without the depixellation film 90. The intensity is at its peak at 92 and gradually decreases on either side of the peak 92 as illustrated by curves 94, 96. Note that the location of the peak 92 is not at the center of the pixel, nor is the rate of decrease of the illumination intensity the same on the left side, as shown by curve 94, as on the right side, as shown by curve 96. The non-uniformity of illumination, as well as the asymmetrical nature of the illumination, may cause field-emission displays to have relatively poor viewing characteristics. In contrast, the use of a depixellation film 90 causes the illumination characteristics to be substantially uniform at level 98 and then drop off quickly at opposite sides of the pixel as illustrated by lines 100, 102, as illustrated in FIG. 8.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A field-emission display faceplate comprising:

a transparent substrate having an inner surface and an outer surface through which an image is adapted to be viewed;

a substantially transparent layer of conductive material coating the inner surface of the substrate;

a layer of cathodoluminescent material coating the layer of conductive material; and a depixellation film containing microlenses overlying a surface of the substrate.

2. The field-emission display faceplate of claim 1 wherein the depixellation film overlies the outer surface of the substrate.

3. The field-emission display faceplate of claim 2 wherein the depixellation film is supported on the outer surface of the substrate.

4. The field-emission display faceplate of claim 1 wherein the depixellation film overlies the inner surface of the substrate.

5. The field-emission display faceplate of claim 4 wherein the depixellation film is supported on the inner surface of the substrate between the substrate and the substantially transparent layer of conductive material.

6. A field-emission display faceplate comprising:

a transparent substrate having an inner surface and an outer surface through which an image is adapted to be viewed;

a substantially transparent layer of conductive material coating the inner surface of the substrate;

a layer of cathodoluminescent material coating the layer of conductive material; and a film containing a plurality of microlenses overlying a surface of the substrate.

7. The field-emission display faceplate of claim 6 wherein the film containing a plurality of microlenses overlies the outer surface of the substrate.

8. The field-emission display faceplate of claim 7 wherein the film containing a plurality of microlenses is supported on the outer surface of the substrate.

9. The field-emission display faceplate of claim 6 wherein the film containing a plurality of microlenses overlies the inner surface of the substrate.

10. The field-emission display faceplate of claim 9 wherein the film containing a plurality of microlenses is supported on the inner surface of the substrate between the substrate and the substantially transparent layer of conductive material.

11. The field-emission display faceplate of claim 6 wherein the microlenses comprise graded refractive index microlenses.

12. A field-emission display faceplate comprising:

a transparent substrate having an inner surface and an outer surface through which an image is adapted to be viewed;

a substantially transparent layer of conductive material coating the inner surface of the substrate;

a layer of cathodoluminescent material coating the layer of conductive material; and a plurality of microlenses mounted on a surface of the substrate.

13. The field-emission display faceplate of claim 12 wherein the plurality of microlenses are mounted on the inner surface of the substrate.

14. The field-emission display faceplate of claim 12 wherein the plurality of microlenses are mounted on the outer surface of the substrate.

15. The field-emission display faceplate of claim 12 wherein the microlenses comprise graded refractive index microlenses.

16. A field-emission display comprising:

a baseplate comprising:

a substrate;

a plurality of emitters mounted on the substrate; and an extraction grid adjacent each emitter; and a faceplate positioned parallel to and spaced apart from the baseplate, the faceplate comprising:

a transparent substrate having an inner surface facing the baseplate and an outer surface opposite the inner surface;

a substantially transparent layer of conductive material coating the inner surface of the substrate;

a layer of cathodoluminescent material coating the layer of conductive material; and a depixellation film overlying a surface of the substrate.

17. The field-emission display of claim 16 wherein the depixellation film overlies the outer surface of the substrate.

18. The field-emission display of claim 17 wherein the depixellation film is supported on the outer surface of the substrate.

19. The field-emission display of claim 16 wherein the depixellation film overlies the inner surface of the substrate.

20. The field-emission display of claim 19 wherein the depixellation film is supported on the inner surface of the substrate between the substrate and the substantially transparent layer of conductive material.

21. A field-emission display comprising:

a baseplate comprising:

a substrate;

a plurality of emitters mounted on the substrate; and an extraction grid adjacent each emitter; and a faceplate positioned parallel to and spaced apart from the baseplate, the faceplate comprising:

a transparent substrate having an inner surface facing the baseplate and an outer surface opposite the inner surface;

a substantially transparent layer of conductive material coating the inner surface of the substrate;

a layer of cathodoluminescent material coating the layer of conductive material; and a film containing a plurality of microlenses overlying the outer surface of the substrate.

22. The field-emission display of claim 21 wherein the film containing a plurality of microlenses overlies the outer surface of the substrate.

23. The field-emission display of claim 22 wherein the film containing a plurality of microlenses is supported on the outer surface of the substrate.

24. The field-emission display of claim 21 wherein the film containing a plurality of microlenses overlies the inner surface of the substrate.

25. The field-emission display of claim 24 wherein the film containing a plurality of microlenses is supported on the inner surface of the substrate between the substrate and the substantially transparent layer of conductive material.

26. The field-emission display of claim 21 wherein the microlenses comprise graded refractive index microlenses.

27. A field-emission display comprising:

a baseplate comprising:

a substrate;

a plurality of emitters mounted on the substrate; and an extraction grid adjacent each emitter; and a faceplate positioned parallel to and spaced apart from the baseplate, the faceplate comprising:

a transparent substrate having an inner surface facing the baseplate and an outer surface opposite the inner surface;

a substantially transparent layer of conductive material coating the inner surface of the substrate;

a layer of cathodoluminescent material coating the layer of conductive material; and a plurality of microlenses mounted on the outer surface of the substrate.

28. The field-emission display of claim 27 wherein the microlenses comprise graded refractive index microlenses.

29. A method of improving the viewing characteristics of a field-emission display of the type including a faceplate having an inner surface and an outer surface through which an image formed by a plurality of pixels is adapted to be visible, the method comprising averaging in substantially all directions the intensity of light emitted by a plurality of the pixels over the respective areas of the pixels so that the light emitted by such pixels is relatively uniform.

30. The method of claim 29 wherein the step of averaging the intensity of light emitted by a plurality of the pixels is provided by positioning a sheet of depixellation film so that it overlies the outer surface of the faceplate.

31. The method of claim 30 wherein the step of positioning a sheet of depixellation film so that it overlies the outer surface of the faceplate is provided by placing the sheet of depixellation film on the outer surface of the faceplate.

32. The method of claim 29 wherein the step of averaging the intensity of light emitted by a plurality of the pixels is provided by positioning a sheet of depixellation film so that it overlies the inner surface of the faceplate.

33. The method of claim 32 wherein the step of positioning a sheet of depixellation film so that it overlies the inner surface of the faceplate is provided by placing the sheet of depixellation film on the inner surface of the faceplate.

34. The method of claim 29 wherein the step of averaging the intensity of light emitted by a plurality of the pixels is provided by placing a plurality of microlenses on a surface of the faceplate.

35. The method of claim 34 wherein the step of placing a plurality of microlenses on a surface of the faceplate is provided by placing a plurality of microlenses on the inner surface of the faceplate.

36. The method of claim 34 wherein the step of placing a plurality of microlenses on a surface of the faceplate is provided by placing a plurality of microlenses on the outer surface of the faceplate.

37. The method of claim 34 wherein the microlenses comprise grad ed refractive index microlenses.

38. A method of improving the viewing characteristics of a field-emission display of the type including a faceplate having an inner surface and an outer surface through which an image formed by a plurality of pixels is adapted to be visible, the method comprising spreading light emitted from a plurality of locations at each of a plurality of the pixels in substantially all directions so that the light emitted from each of the locations overlaps light emitted from other locations.

39. The method of claim 38 wherein the step of spreading light emitted from a plurality of locations at each of a plurality of the pixels is provided by positioning a sheet of depixellation film so that it overlies the outer surface of the faceplate.

40. The method of claim 39 wherein the step of positioning a sheet of depixellation film so that it overlies the outer surface of the faceplate is provided by positioning a sheet of depixellation film on the outer surface of the faceplate.

41. The method of claim 38 wherein the step of spreading light emitted from a plurality of locations at each of a plurality of the pixels is provided by positioning a sheet of depixellation film so that it overlies the inner surface of the faceplate.

42. The method of claim 41 wherein the step of positioning a sheet of depixellation film so that it overlies the inner surface of the faceplate is provided by positioning the sheet of depixellation film on the inner surface of the faceplate.

43. The method of claim 38 wherein the step of spreading light emitted from a plurality of locations at each of a plurality of pixels is provided by positioning a sheet of film containing a plurality of microlenses so that it overlies the outer surface of the faceplate.

44. The method of claim 43 wherein the step of positioning a sheet of film containing a plurality of microlenses so that it overlies the outer surface of the faceplate is provided by positioning the sheet of film containing a plurality of microlenses on the outer surface of the faceplate.

45. The method of claim 38 wherein the step of spreading light emitted from a plurality of locations at each of a plurality of pixels is provided by positioning a sheet of film containing a plurality of microlenses so that it overlies the inner surface of the faceplate.

46. The method of claim 45 wherein the step of positioning a sheet of film containing a plurality of microlenses so that it overlies the inner surface of the faceplate is provided by positioning the sheet of film containing a plurality of microlenses on the inner surface of the faceplate.

47. The method of claim 38 wherein the step of spreading light emitted from a plurality of locations at each of a plurality of pixels is provided by placing a plurality of microlenses on the outer surface of the faceplate.

48. The method of claim 47 wherein the microlenses comprise graded refractive index microlenses.

49. The method of claim 38 wherein the step of spreading light emitted from a plurality of locations at each of a plurality of pixels is provided by placing a plurality of microlenses on the inner surface of the faceplate.

50. The method of claim 49 wherein the microlenses comprise graded refractive index microlenses.

* * * * *